US006789665B2

(12) United States Patent
Staiano

(10) Patent No.: US 6,789,665 B2
(45) Date of Patent: Sep. 14, 2004

(54) POUCH FOR SMOKING ACCESSORIES WITH DETACHABLE STORAGE

(76) Inventor: Mark Joseph Staiano, 103 Wildwood Ct., Athens, GA (US) 30606

( * ) Notice: Subject to any disclaimer, the term of this patent is extended or adjusted under 35 U.S.C. 154(b) by 0 days.

(21) Appl. No.: 10/352,262

(22) Filed: Jan. 27, 2003

(65) Prior Publication Data

US 2004/0144660 A1 Jul. 29, 2004

(51) Int. Cl.[7] ..... B65D 69/00
(52) U.S. Cl. ..... 206/236; 206/244; 206/260
(58) Field of Search ..... 206/260, 261, 206/262, 263, 581, 478, 479, 481, 483, 823, 372, 373, 37, 35, 236, 237, 238; 150/131, 113, 147; 190/110; 383/38–40

(56) References Cited

U.S. PATENT DOCUMENTS 1,614,108 A * 1/1927 Deitsch ..... 190/110
1,705,149 A * 3/1929 Brady ..... 190/111
2,167,926 A * 8/1939 Glasker ..... 206/581
2,937,728 A * 5/1960 Koffler ..... 190/110
4,386,642 A * 6/1983 Durbin ..... 190/110
5,447,215 A * 9/1995 Volkmar et al. ..... 190/11
5,829,502 A * 11/1998 Distefano et al. ..... 150/113
5,845,780 A * 12/1998 Allen ..... 206/579
6,041,921 A * 3/2000 Staiano et al. ..... 206/236
6,109,442 A * 8/2000 Roegner ..... 206/581
6,547,070 B1 * 4/2003 Kolpin ..... 206/317
6,578,707 B2 * 6/2003 Staiano ..... 206/236
6,634,473 B1 * 10/2003 Wagner ..... 190/110

* cited by examiner

*Primary Examiner*—Shian T. Luong
(74) *Attorney, Agent, or Firm*—Ostrolenk, Faber, Gerb & Soffen LLP

(57) ABSTRACT

A pouch for tobacco and smoking items and accessories includes first and second outside panels that are attached at an edge and are foldable relative to each other between an open position and a closed condition. A first pocket panel on the first outside panel and a second pocket panel on the second outside panel. A separate pouch for storage of tobacco or other materials which pouch is detachably attached, e.g. by a hook and loop fastening to the first panel. A double-loop, item support attached to the second pocket panel. The double-loop is formed from a single piece of elastic material which is secured to the second pocket panel.

7 Claims, 1 Drawing Sheet

POUCH FOR SMOKING ACCESSORIES WITH DETACHABLE STORAGE

BACKGROUND OF THE INVENTION

The present invention relates to a pouch for holding smoking accessories and is an improvement on the pouch in application Ser. No. 09/928,548. More particularly, the present invention relates to such a foldable pouch with an easily installed and removed smaller pouch, particularly the pouch used to hold tobacco. The pouch also includes a loop arrangement within the pouch for holding smoking accessories.

SUMMARY OF THE INVENTION

There is a need to provide a smoker's pouch which accommodates smoking accessories and which enables firm attachment and detachment of one pouch, and particularly a tobacco pouch, from the main pouch.

The present invention attempts to solve the foregoing problem by providing a pouch for smoking accessories which incorporates a separate tobacco pouch without compromising the integrity of the material used for the pouch construction.

The pouch includes a first outside panel and a second outside panel connected at a folding section. The first and second panels are foldable relative each other between an open position and a closed position. The pouch further includes a first pocket panel inside the first outside panel and a second pocket panel inside the second outside panel.

A closable storage satchel or pouch may be detachably attached to the first pocket panel, e.g. by an appropriate fastening, such as hook and loop fastening under the trademark Velcro. It can hold loose tobacco, for example.

This arrangement has several advantages. Management of the contents of the entire pouch is easier, since it is easier to handle a separable storage pouch than the larger entire pouch with its other accessories. If the storage pouch becomes dirty from tobacco or other herbs, or the like, in the storage pouch, removal of the storage pouch allows it to be cleaned, whereas the remainder of the pouch may not require cleaning. If any part of the entire pouch becomes dirty, lost or damaged, replacement of only part of the entire pouch is easy and less expensive.

As described in the above noted prior application, a double-loop arrangement may be attached to the second pocket panel. The double-loop arrangement is preferably formed from a single loop of flexible, slightly elastic material which is secured to the second pocket panel and is shaped to define two different size loops. The double loop arrangement is attached to the second pocket panel without insertion in slits or other holes in the second pocket partition. Without slits or other holes in the material comprising the pouch, the pouch can be constructed of any desired material, including leather, canvas, vinyl, a non-woven material or the like. More significantly, the pouch, or at least its pocket panels, can be economically constructed from any natural or synthetic woven material without suffering fraying, unraveling or any similar accelerated degradation of the pouch material due to the attachment and subsequent use or manipulation of the loop arrangement.

BRIEF DESCRIPTION OF THE DRAWINGS

Other features and advantages of the present invention will become apparent from the following description of the invention which refers to the accompanying drawings, wherein.

DESCRIPTION OF A PREFERRED EMBODIMENT OF THE INVENTION

Figure 1:
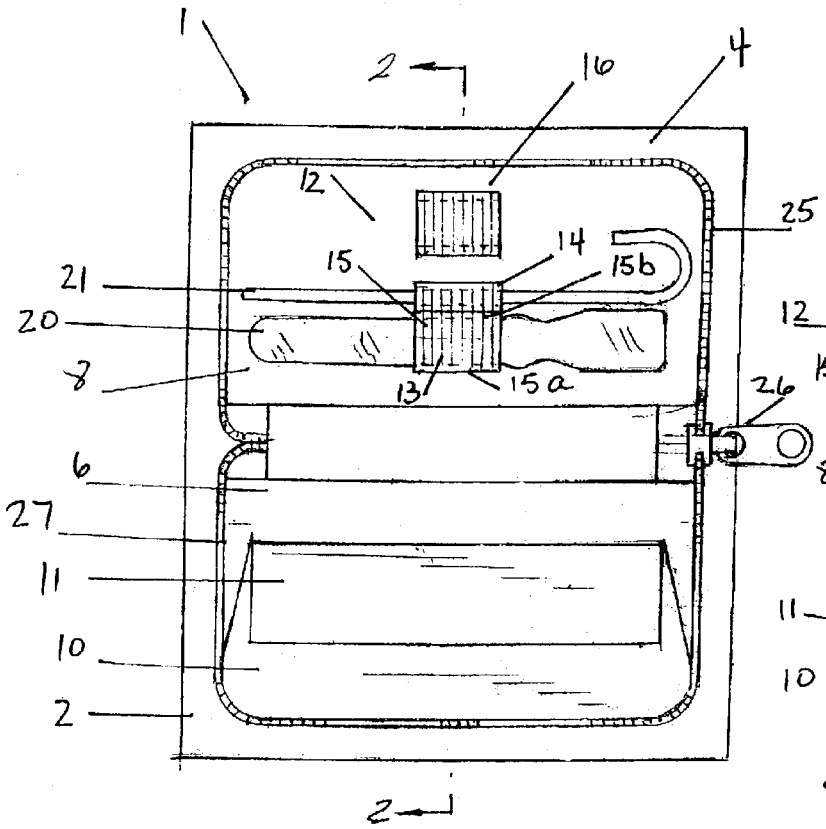
FIG. 1 shows a preferred embodiment of the pouch of the present invention in the open position.

Referring to the drawings, FIG. 1 shows a smoker's pouch 1 according to a preferred embodiment. The pouch 1 includes a first outside panel 2 and a second outside panel 4 secured to the first panel 2 at a foldable section 5. The first and second panels 2 and 4 are foldable relative to each other at section 5 between an open position shown in FIG. 1 and a closed position shown in FIG. 2.

The pouch 1 further includes a first pocket panel 6 on the inside of the first outside panel 2 and a second pocket panel 8 on the inside of the second outside panel 4.

A storage satchel or pouch 10 is detachably attached to the first pocket panel 6. The mode of attachment may be by a hook and loop fastener 30, under the trademark Velcro. Other detachable fastenings may alternatively be used, including a snap or several snaps, a separate zipper connection or even tape. The storage pouch 10 may hold any article, like a smoking material such as loose tobacco for cigarettes or pipes. For this reason, the storage pouch is provided with a closing flap 11. The closing flap includes a securing member, such as a hook-and-loop strip, i.e., Velcro, which retains the flap closed. Other securing members include buttons, snaps or hooks.

Each of the first pocket panel 6, the second pocket panel 8 and the storage satchel 10 create pockets within the pouch 1 for the storage of smoking needs and accessories, as well as other items such as credit cards, cigarette rolling papers, money, etc. Such pockets may be created between the first pocket panel 6 and the first outside panel 2; between the second pocket panel 8 and the second outside panel 4; and depending upon the nature of the attachment between the storage pouch 10 and the second pocket panel 8.

A double-loop arrangement 12 is attached to the inner side of the second pocket panel 8, i.e., the inner side when the panels 6 and 8 are folded closed. The double-loop arrangement 12 is preferably comprised of a single piece of loop forming material 15 which is secured to the second pocket panel 8 at a location along the piece of material so as to form two different size loops 13 and 14 without providing slits or other holes or cuts in the second pocket panel 8. To form the two loops 13 and 14, a first edge 15*a* of the loop material 15 is secured to the panel 8, the remaining loop material 15 is folded under and is secured at its other end to the pocket panel 8. Along the length of material, it is again attached to the panel to the panel 8 along line 15*b*, e.g. by being sewn there, to thereby define the two loops. The double-loop arrangement 12 is preferably secured by being sewn to the panel 8. The material of the double loop is preferably elastic, to stretch for allowing insertion and removal of each smoking essential or accessory in its loop and for holding each installed item securely in place.

Each of the loops 13 and 14 is sized to be able to hold different smoking items or accessories. The larger loop 13 is of a size to hold the stem of a pipe 20, a cigarette, or the like. The smaller loop 14 is much smaller and of a size to hold a pipe poker 21. Because the poker 21 has its own specifically dimensioned loop 14, a smoker need not completely remove the poker from its loop when using it, which prevents the poker from being lost or misplaced. The poker may be partially withdrawn so that its point protrudes beyond the side edge of its panel 8, where it can be pushed into a pipe.

Both the pouch and the separate attachable pouch may be constructed of any desired material, including leather, canvas, vinyl or the like, and economically from any natural or synthetic woven material without danger of fraying, unraveling or any similar accelerated degradation of the pouch material due to holes used for the loops.

As shown in FIG. 1, the pouch 1 may also be provided with a separate third loop 16 attached to the second pocket panel 8 above the loop arrangement 12. Similar to the double-loop arrangement 12, the third loop 16 is preferably attached to the second pocket panel 8 without passing through slits or holes in the panel. The third loop 16 is preferably sewn to the second pocket panel 8 or, in the alternative, is secured to it with an adhesive.

In alternate embodiments, the first pocket panel 6 and/or the second pocket panel 8 can be omitted from the pouch 1. If the first pocket panel 6 is omitted, then the storage pouch 10 may be detachably attached to the first outside panel 2. If the second pocket panel 8 is omitted, the above described double-loop arrangement 12 can be secured directly to the second outer panel 4 in the same manner as described above.

Figure 2:
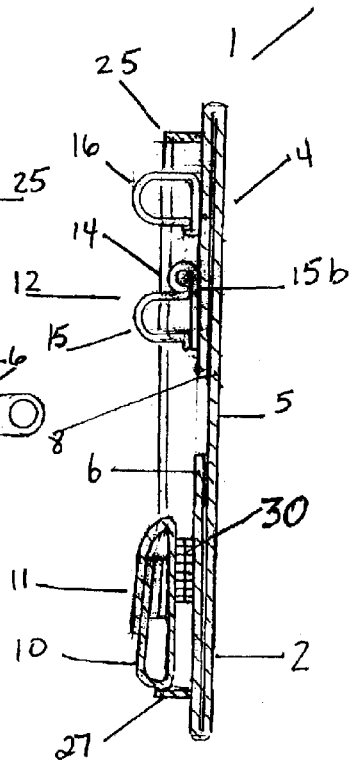
FIG. 2 is a side cross-section on 2—2 in FIG. 1.
Figure 3:
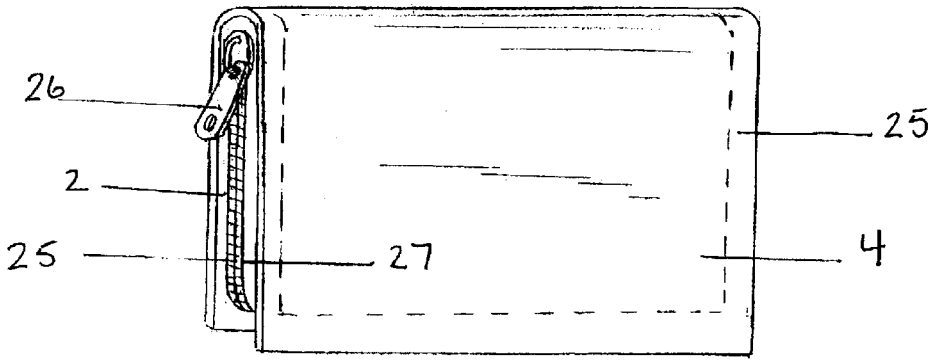
FIG. 3 shows the pouch of FIG. 1 in the closed position.

The first and second panels 2 and 4 are provided with a closure 25, which retains the pouch 1 in the closed position shown in FIG. 2. The closure 25 may be a zipper around the periphery of each of the outside panels 2 and 4. When the first and second panels 2 and 4 are folded to each other, the zipper pull 26 can close the zipper and close the pouch 1. Other closures, such as Velcro, buttons, snaps or straps may be substituted.

The closed pouch 1 may be compact to enable it to be easily and unobtrusively placed in a clothing pocket. For example, closed pouch 1 can measure from 1 to 4 inches in height, from 2 to 8 inches in length, and less than 2 inches in thickness.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A pouch for smoking items and accessories comprising:

a first panel with a foldable edge;

a second panel with a foldable edge and the second panel being secured to the first panel at the foldable edges; the panels having inner sides which are brought together when the panels are folded together around their edges; and a separate storage pouch;

a detachable attachment device on at least one of the separate pouch and the inner side of the first panel for detachably attaching the pouch to the inner side of the first panel, whereby the separate pouch may be exchanged or replaced; a double-loop arrangement formed from a single piece of material attached to the inner side of the first panel, wherein the single piece of material has ends and the loops of the double loop arrangement are formed from the single piece by securing the single piece intermediate the ends thereof to the first panel.

2. The pouch of claim 1, wherein the double-loop arrangement includes two different size loops.

3. The pouch of claim 1, further comprising a third loop attached to the inner side of the panels.

4. The pouch of claim 1, wherein the piece of material is of an elastic.

5. The pouch of claim 1, further comprising a closing flap closing the storage pouch.

6. The pouch of claim 1, further comprising a closure attached to the first and second panels for retaining the pouch in a closed condition with the first and second panels folded together.

7. The pouch of claim 1, wherein the detachable attachment device comprises a hook and loop connection between the storage pouch and the first panel.

* * * * *